US009120325B2

(12) United States Patent
Ito et al.

(10) Patent No.: US 9,120,325 B2
(45) Date of Patent: Sep. 1, 2015

(54) EJECTION INSPECTION METHOD AND LIQUID EJECTION DEVICE

(71) Applicant: SEIKO EPSON CORPORATION, Tokyo (JP)

(72) Inventors: Takeshi Ito, Suwa (JP); Tsuyoshi Kato, Shiojiri (JP); Osamu Kasuga, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 14/068,106

(22) Filed: Oct. 31, 2013

(65) Prior Publication Data

US 2014/0125728 A1 May 8, 2014

(30) Foreign Application Priority Data

Nov. 5, 2012 (JP) ..... 2012-243334

(51) Int. Cl.
*B41J 29/393* (2006.01)
*B41J 2/21* (2006.01)
*B41J 29/38* (2006.01)

(52) U.S. Cl.
CPC ..... *B41J 2/2139* (2013.01); *B41J 2/2142* (2013.01); *B41J 29/38* (2013.01); *B41J 29/393* (2013.01); *B41J 2029/3935* (2013.01)

(58) Field of Classification Search
CPC ..... B41J 2/125; B41J 29/38; B41J 2/2142; B41J 2029/3935; B41J 29/393
USPC ..... 347/18, 19
See application file for complete search history.

(56) References Cited

U.S. PATENT DOCUMENTS

| | | | | |
|---|---|---|---|---|
| 6,893,114 | B2 * | 5/2005 | Yano et al. | 347/43 |
| 2003/0085940 | A1 | 5/2003 | Yamada | |
| 2005/0062782 | A1 | 3/2005 | Endo et al. | |
| 2005/0093904 | A1 | 5/2005 | Ishimoto et al. | |
| 2011/0074906 | A1 * | 3/2011 | Imai | 347/218 |

FOREIGN PATENT DOCUMENTS

| | | | | |
|---|---|---|---|---|
| JP | 2000-043382 | A | | 2/2000 |
| JP | 2004-314362 | A | | 11/2004 |
| JP | 2005-022216 | A | | 1/2005 |
| JP | 2005-022217 | A | | 1/2005 |
| JP | 2005-047024 | A | | 2/2005 |
| JP | 2005-297503 | A | | 10/2005 |
| JP | 2005297503 | A | * | 10/2005 |
| JP | 2008087287 | A | * | 4/2008 |
| JP | 2009-051218 | A | | 3/2009 |
| JP | 2010-132005 | A | | 6/2010 |

* cited by examiner

*Primary Examiner* — Alessandro Amari
*Assistant Examiner* — Michael Konczal
(74) *Attorney, Agent, or Firm* — Global IP Counselors, LLP

(57) ABSTRACT

An ejection inspection method includes: preparing a liquid ejection nozzle for ejecting liquid onto a recording medium; irradiating a pattern formed by the liquid ejected onto the recording medium with light; and conducting ejection inspection of the liquid ejection nozzle based on results of observing or recognizing reflected light or transmitted light of the light from the recording medium. The recording medium includes an ink absorption layer having light transmittance where a great number of void cells having a particle diameter smaller than wavelength of the light are dispersed into a joining material, and an ejection amount of the liquid is adjusted such that a region where the liquid is sufficiently filled in the void cells and a region where substantially no liquid is filled exist in a thickness direction and a horizontal direction in planar view of the ink absorption layer.

10 Claims, 6 Drawing Sheets

EJECTION INSPECTION METHOD AND LIQUID EJECTION DEVICE

CROSS-REFERENCE TO RELATED APPLICATIONS

This application claims priority to Japanese Patent Application No. 2012-243334 filed on Nov. 5, 2012. The entire disclosure of Japanese Patent Application No. 2012-243334 is hereby incorporated herein by reference.

BACKGROUND

1. Technical Field

The present invention relates to an ejection inspection method and a liquid ejection device.

2. Related Art

As a liquid droplet ejection head provided with a liquid ejection nozzle which can eject liquid in a liquid droplet state, an inkjet recording head used for an image recording device (liquid ejection device) such as a printer has been put into practical use. Further, these days, application to various devices has been considered making use of the characteristics that a very small amount of liquid can be ejected with good accuracy. For example, a color material ejection head used for manufacturing a color filter such as a liquid crystal display, or an electrode material ejection head used for forming an electrode for an organic EL (Electro Luminescence) display, an FED (Field Emission Display), or the like has been proposed.

In general, this type of liquid droplet ejection head has a plurality of nozzle openings, and liquid droplets are ejected from each of the nozzle openings. Therefore, liquid is exposed to the atmosphere in the nozzle opening, and a solvent component of the liquid evaporates through meniscus (free surface of liquid exposed in the nozzle opening). Evaporation of the solvent component causes increase in the concentration of other components which constitute the liquid, which results in deviation of the flight of liquid droplets, clogging in the nozzle opening, or the like. Further, if a nozzle opening is put into a clogging state, the nozzle opening cannot eject liquid droplets, which might cause various problems. For example, in a recording head, dots are not allowed to land onto correct landing positions on a recording medium, which might cause deterioration in the image quality, or the ejection amount of liquid is shifted from a proper amount, which might cause a situation in which desired characteristics cannot be obtained.

It is important to detect whether or not a defective dot occurs in order to achieve desired performance, and this detection is conducted using an observable test pattern. For example, in the above-described image recording device, a test pattern is recorded on recording paper, and the density of the test pattern is optically read (see Japanese Laid-open Patent Publication No. 2000-43382).

SUMMARY

During the recent progress of high function, downsizing and thinning of electronic devices, more precise control of the ejection amount and high accuracy of the landing position are required for ejection of functional liquid by the liquid droplet ejection head. Therefore, in ejection inspection conducted by recording a test pattern, the physical amount such as the landing position or the landing area of the test pattern needs to be accurately grasped as well as detection of existence or non-existence of a defective dot.

Also, recently, it has been considered that colorless transparent liquid, which is called as clear ink, is ejected from the liquid droplet ejection head as ink in addition to color ink such as cyan, magenta, yellow, black, and the like, so as to adjust the quality of an image. For example, transparent ink is used for making the gloss of an image uniform. More specifically, when recording on standard paper (to which a gloss treatment has not been conducted) with pigment-based colored ink, there are cases in which a difference in the gloss occurs between a portion recorded with colored ink and a portion of the ground color of the standard paper. In such cases, the gloss of the recording region and the non-recording region can be made uniform by causing pigment ink to land on the non-recording region.

However, the above-described transparent liquid is difficult to observe even if a test pattern is recorded, and it is difficult to optically read or electrically recognize. Therefore, the system of reading (recognizing) a test pattern becomes complicated and expensive. In addition, there is another problem that it is difficult to finely detect the physical amount such as the landing position or the landing area of the test pattern.

The present invention has been made to address at least part of the above-described circumstances, and the present invention can be implemented as the following embodiments or application examples.

An ejection inspection method according to the present application example includes preparing a liquid ejection nozzle for ejecting liquid onto a recording medium, irradiating a pattern formed by the liquid ejected onto the recording medium with light, and conducting ejection inspection of the liquid ejection nozzle based on results of observing or recognizing reflected light or transmitted light of the light from the recording medium, in which the recording medium includes an ink absorption layer having light transmittance where a great number of void cells having a particle diameter smaller than wavelength of the light are dispersed into a joining material, and an ejection amount of the liquid is adjusted such that a region where the liquid is sufficiently filled in the void cells and a region where substantially no liquid is filled exist in a thickness direction and a horizontal direction in planar view of the ink absorption layer.

The inventors have found that, with this configuration, even in a case of using transparent ink which is hard to observe or recognize in a conventional ejection inspection method which optically recognizes a pattern (test pattern) formed by observable liquid, it becomes possible to observe or recognize the test pattern, and it is also possible to detect the physical amount such as the landing position or the landing area (ejection amount) of the liquid.

Specifically, the test pattern is formed by adjusting the ejection amount of the liquid such that a region where the liquid is sufficiently filled in a great number of void cells dispersed in the ink absorption layer and a region where substantially no liquid is filled exist in a thickness direction and a horizontal direction in planar view of the ink absorption layer, the test pattern is irradiated with light having wavelength sufficiently longer than the particle diameters of the void cells, and reflected light or transmitted light from the recording medium is observed or electrically recognized using an image capturing element. With this, it is possible to relatively easily observe or recognize the boundary surface between the region where the liquid is sufficiently filled and the region where substantially no liquid is filled, and it is thus possible to obtain the physical amount such as the landing position or the landing area of the test pattern.

Therefore, even in a case of using transparent ink as liquid, highly accurate ejection inspection of the liquid ejection nozzle can be conducted by obtaining the physical amount of the test pattern (liquid) which has landed onto the recording medium without using a complicated and expensive optical system or image processing device, and a stable drawing (recording) quality by the liquid ejection nozzle can be preserved.

In the ejection inspection method according to the above-described application example, preferably, the reflected light or the transmitted light from the recording medium is electrically recognized by an image capturing element.

With this application example, since the image capturing element recognizes the reflected light or the transmitted light from the recording medium by converting it into electrical signals, it is possible to configure an ejection inspection system which can recognize the physical amount of the test pattern efficiently and highly accurately by conducting image processing to recognized electrical signals using an image processing device.

In the ejection inspection method according to the above-described application example, preferably, the liquid ejection nozzle is a nozzle provided in a liquid droplet ejection head for ejecting liquid as liquid droplets by an inkjet method.

With this configuration, since the liquid droplet ejection head provided with the liquid ejection nozzle using an inkjet method can conduct highly fine drawing (recording) by accurately controlling the ejection characteristics such as the ejection amount, the ejection position, and the like, image recording (liquid ejection) of a stable quality can be achieved with the ejection characteristics of the nozzle being preserved by applying the ejection inspection method according to the above-described application example which can conduct highly accurate ejection inspection.

In the ejection inspection method according to the above-described application example, the liquid is transparent liquid having high light transmittance.

With this application example, even in a case of using transparent ink which is hard to observe or recognize in a conventional ejection inspection method which optically recognizes a test pattern formed by observable liquid, it becomes possible to observe or recognize the test pattern, and it is also possible to detect the physical amount such as the landing position or the landing area (ejection amount) of the liquid so as to contribute to stabilization of the liquid ejection characteristics of the nozzle.

An ejection inspection device according to the present application example has a liquid ejection nozzle for ejecting liquid onto a recording medium, and an ejection inspection section which has an irradiating part configured and arranged to irradiate a pattern formed by the liquid ejected onto the recording medium with light and a light recognizing part configured and arranged to recognize light from the recording medium irradiated with the light of the irradiating part, and conducts ejection inspection of the liquid ejection nozzle based on results recognized by the light recognizing part. The recording medium includes an ink absorption layer having light transmittance in which a great number of void cells having a particle diameter smaller than wavelength of the light are dispersed into a joining material. The ejection inspection device further has an ejection control section which adjusts an ejection amount of the liquid such that a region where the liquid is sufficiently filled in the void cells and a region where substantially no liquid is filled exist in a thickness direction and a horizontal direction in planar view of the ink absorption layer. The light recognizing part includes a reflected light recognizing section configured and arranged to recognize reflected light of the light from the recording medium and a transmitted light recognizing section configured and arranged to recognize transmitted light of the light from the recording medium.

According to the present application example, with this configuration, the ejection inspection device has an ejection inspection section which can detect the physical amount such as the landing position or the landing area (ejection amount) of a test pattern even in a case of using transparent ink which is hard to observe or recognize in a conventional ejection inspection method which optically recognizes a test pattern formed by observable liquid.

Also, according to the present application example, since the reflected light recognizing section and the transmitted light recognizing section are provided as the light recognizing part, it is possible to conduct inspection of a test pattern by selecting either one of reflected light and transmitted light from the recording medium of the light emitted from the irradiating part. In other words, according to the ejection inspection method using the ejection inspection section of the present application example, it is possible to detect the physical amount of the landing liquid (test pattern) with either one of reflected light and transmitted light from the recording medium irradiated with light. As a result of this, it is possible to conduct ejection inspection by selecting the light recognizing part as appropriate depending on the kind of the liquid or the recording medium in use.

Therefore, ejection inspection of the nozzle can be conducted corresponding to the ejection conditions such as the kind of the recording medium or the liquid without using a complicated and expensive optical system or image processing device, and thus a liquid ejection device, which can achieve image recording (liquid ejection) of a stable quality by preserving the ejection characteristics of the nozzle, can be provided.

In the ejection inspection device according to the above-described application example, preferably, the reflected light recognizing section and the transmitted light recognizing section include an image capturing element which electrically recognizes the reflected light or the transmitted light from the recording medium.

According to this application example, by recognizing the reflected light or the transmitted light from the recording medium and converting it into electrical signals with the image capturing element, and conducting image processing to the electrical signals using an image processing device, the physical amount of the test pattern can be recognized efficiently and accurately, and feedback of the recognized physical amount of the test pattern can be provided to liquid ejection control relatively easily.

In the ejection inspection device according to the above-described application example, the liquid ejection nozzle is a nozzle provided in a liquid droplet ejection head for ejecting liquid as liquid droplets by an inkjet method.

According to this application example, since the liquid droplet ejection head (inkjet head) provided with the liquid ejection nozzle using an inkjet method can conduct highly fine drawing (recording) by accurately controlling the ejection characteristics such as the ejection amount, the ejection position, and the like, it is possible to provide a liquid ejection device which can achieve image recording (liquid ejection) of a stable quality with the ejection characteristics of the nozzle being preserved in combination with the ejection inspection section which can conduct highly accurate ejection inspection.

In the ejection inspection method according to the above-described application example, transparent liquid having high light transmittance is used as the liquid.

According to this application example, even in a case of using transparent ink which is hard to observe or recognize in a conventional ejection inspection method which optically recognizes a test pattern formed by observable liquid, it becomes possible to observe or recognize the test pattern, and it is also possible to detect the physical amount such as the landing position or the landing area (ejection amount) of the liquid so as to contribute to stabilization of the liquid ejection characteristics of the nozzle.

BRIEF DESCRIPTION OF THE DRAWINGS

Referring now to the attached drawings which form a part of this original disclosure:

FIGS. 1A to 1C show an example of a configuration of a liquid droplet ejection device as a liquid ejection device according to an embodiment, in which FIG. 1A is a simplified perspective view which shows the entire configuration of the liquid droplet ejection device, FIG. 1B is a schematic plan view which shows an arrangement of a liquid droplet ejection head, and FIG. 1C is a schematic cross-sectional view of a main part for explaining a structure of the liquid droplet ejection head.

FIGS. 6A and 6B schematically show an embodiment of an ejection inspection method, in which FIG. 6A is a plan view of a test pattern for ejection inspection caused to land on a recording medium, and FIG. 6B is a schematic view which explains the ejection inspection method with respect to a section of the recording medium shown in FIG. 6A.

DETAILED DESCRIPTION OF EXEMPLARY EMBODIMENTS

Hereinafter, embodiments of the present invention will be explained with reference to the drawings. Here, each element is illustrated in each drawing with a different scale so as to make the size of each element can be recognized in each drawing.

Liquid Droplet Ejection Device

First, a liquid droplet ejection device 6 will be explained with reference to FIGS. 1A to 1C. The liquid droplet ejection device 6 is a liquid ejection device which forms a recorded material (a printed material) by ejecting liquid onto a recording medium. As for the liquid droplet ejection device, various kinds of devices are possible, but a device using an inkjet method is preferable. Since the inkjet method can eject minute liquid droplets, the inkjet method is suitable for fine processing.

Figure 1A:
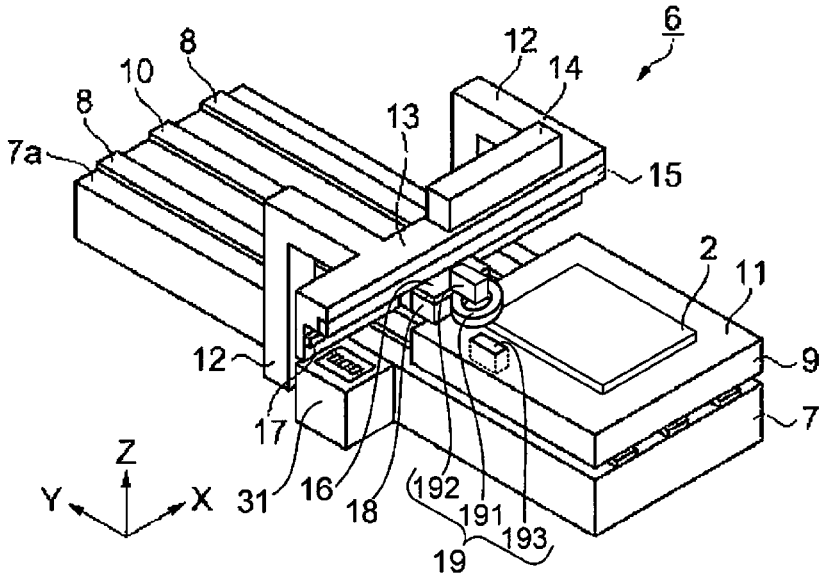

FIG. 1A is a simplified perspective view which shows an example of a configuration of the liquid droplet ejection device 6. Liquid droplets are ejected by the liquid droplet ejection device 6.

As shown in FIG. 1A, the liquid droplet ejection device 6 has a base board 7 formed in a cuboid shape. In the present embodiment, the longitudinal direction of the base board 7 is defined as a Y direction, and a direction orthogonal to the Y direction on a horizontal plane is defined as an X direction. The vertical direction is defined as a Z direction. A direction in which a liquid droplet ejection head 22 and an ejected material relatively move when ejecting liquid droplets is defined as a main scanning direction. A direction orthogonal to the main scanning direction is a sub scanning direction. The sub scanning direction is a direction in which the liquid droplet ejection head 22 and an ejected material relatively move when inserting line feeds. In the present embodiment, the Y direction is the main scanning direction, and the X direction is the sub scanning direction.

On an upper surface 7*a* of the base board 7, a pair of guide rails 8 extending in the Y direction is provided to protrude over the entire width of the Y direction. A stage 9 is attached to the upper side of the base board 7, and the stage 9 has a direct acting mechanism corresponding to the pair of guide rails 8. The direct acting mechanism is not shown in the drawing. A mechanism such as a linear motor or a screw type direct acting mechanism can be used as the direct acting mechanism of the stage 9. In the present embodiment, for example, a linear motor is employed. The stage 9 is configured to move forward or move backward at a predetermined speed along the Y direction. Repetition of moving forward and moving backward is referred to as scanning movement. Further, on the upper surface 7*a* of the base board 7, a main scanning position detecting device 10 is provided in parallel with the guide rails 8, and the position of the stage 9 is detected by the main scanning position detecting device 10.

A loading surface 11 is formed on an upper surface of the stage 9, and a suction type substrate chuck mechanism is provided on the loading surface 11. The substrate chuck mechanism is not shown in the drawing. A recording medium 2 is set on the loading surface 11, and the recording medium 2 is fixed to the loading surface 11 by the substrate chuck mechanism.

A pair of support boards 12 is vertically provided on both sides of the base board 7 in the X direction. A guide member 13 extending in the X direction is provided to bridge the pair of support boards 12. A container tank 14 is provided on the upper side of the guide member 13, and the container tank 14 contains functional liquid 26 as liquid to be ejected such that the functional liquid 26 can be supplied.

On the lower side of the guide member 13, a guide rail 15 extending in the X direction is provided over the entire width of the X direction. A carriage 16, which is movably attached along the guide rail 15, is formed in a substantially cuboid shape. The carriage 16 has a direct acting mechanism, and a mechanism similar to the direct acting mechanism of the stage 9 can be used as the direct acting mechanism of the carriage 16. The carriage 16 performs scanning movement along the guide rail 15. A sub scanning position detecting device 17 is arranged between the guide member 13 and the carriage 16, and the position of the carriage 16 is measured. A head unit 18 is provided on the lower side of the carriage 16, and a liquid droplet ejection head (not shown in the drawing) is provided to protrude on the stage 9 side of the head unit 18.

An ejection inspection section 19 is provided in the head unit 18 and the stage 9, and the ejection inspection section 19 conducts ejection inspection by detecting the physical amount such as the landing position or the landing area of liquid (liquid droplets) ejected from the liquid droplet ejection head 22. The detailed configuration of the ejection inspection section 19 will be described later.

Figure 1B:
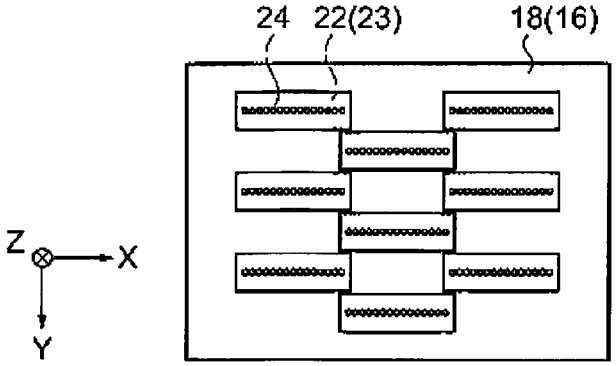

FIG. 1B is a schematic plan view which shows an embodiment of an arrangement of the liquid droplet ejection head 22 provided in the liquid droplet ejection device 6. As shown in FIG. 1B, three liquid droplet ejection heads 22 as ejection sections are provided in the single head unit 18 so as to be arranged at equal intervals in the Y direction. The functional liquid 26 of a red color, a blue color, and a green color is supplied to the three liquid droplet ejection heads 22. The three liquid droplet ejection heads 22, which eject the functional liquid 26 of the respective color, are also provided in the X direction so as to be arranged in a zigzag pattern.

A nozzle plate 23 is provided on a surface of the liquid droplet ejection head 22, and a plurality of liquid ejection nozzles 24 are formed in the nozzle plate 23. The number or arrangement of the liquid ejection nozzles 24 can be set depending on the ejection pattern and the size of the recording medium 2. In the present embodiment, for example, one line of the liquid ejection nozzles 24 is arranged in the single nozzle plate 23, and fifteen liquid ejection nozzles 24 are provided in each line.

Figure 1C:
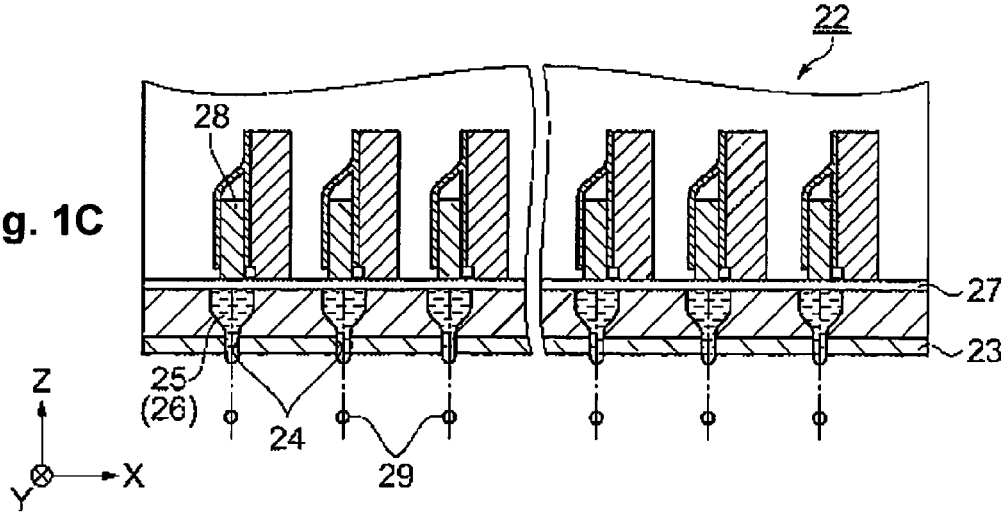

FIG. 1C is a schematic cross-sectional view of a main part for explaining a structure of the liquid droplet ejection head 22. As shown in FIG. 1C, the liquid droplet ejection head 22 has the nozzle plate 23, and the liquid ejection nozzles 24 are formed in the nozzle plate 23. Cavities 25 as pressure chambers connecting to the liquid ejection nozzles 24 are formed in positions to face the liquid ejection nozzles 24 on the upper side of the nozzle plate 23 in the drawing. The functional liquid 26 as liquid retained in the container tank 14 is supplied to the cavity 25 of the liquid droplet ejection head 22 through a flow path which is not shown in the drawing.

A vibration plate 27 and a piezoelectric element 28 are provided on the upper side of the cavity 25. The vibration plate 27 vibrates in the vertical direction (the Z direction) so as to enlarge and reduce the volume inside the cavity 25. The piezoelectric element 28 is a driving element which vibrates the vibration plate 27 by expanding and contracting in the vertical direction. When the liquid droplet ejection head 22 receives element driving signals for controlling and driving the piezoelectric element 28, the piezoelectric element 28 expands and contracts. Consequently, the vibration plate 27 enlarges and reduces the volume inside the cavity 25, and pressurizes the cavity 25. As a result, the functional liquid 26 of a reduced volume is ejected as liquid droplets 29 from the liquid ejection nozzle 24 of the liquid droplet ejection head 22.

Ejection Inspection Section

Figure 2A:
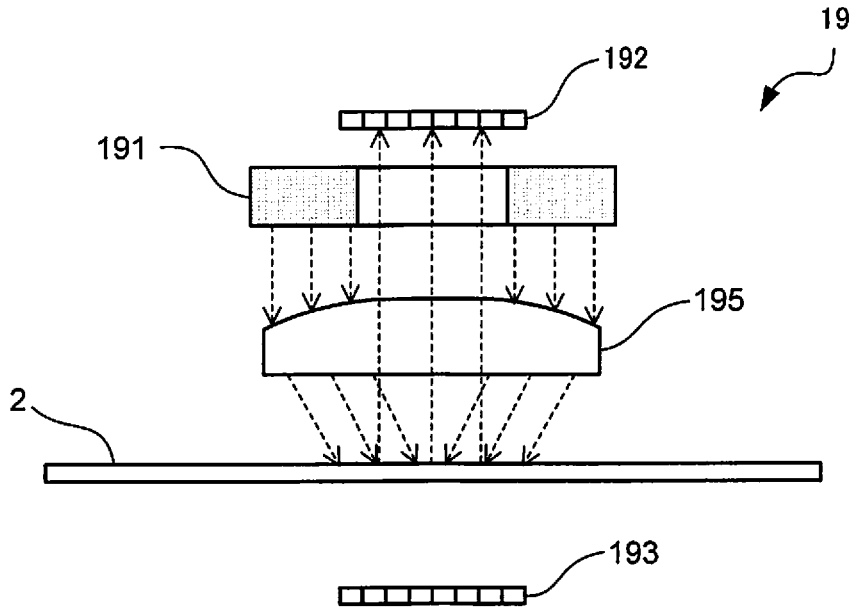
FIGS. 2A and 2B are simplified explanatory diagrams which schematically show a configuration of an ejection inspection section of the liquid droplet ejection device.
Figure 2B:
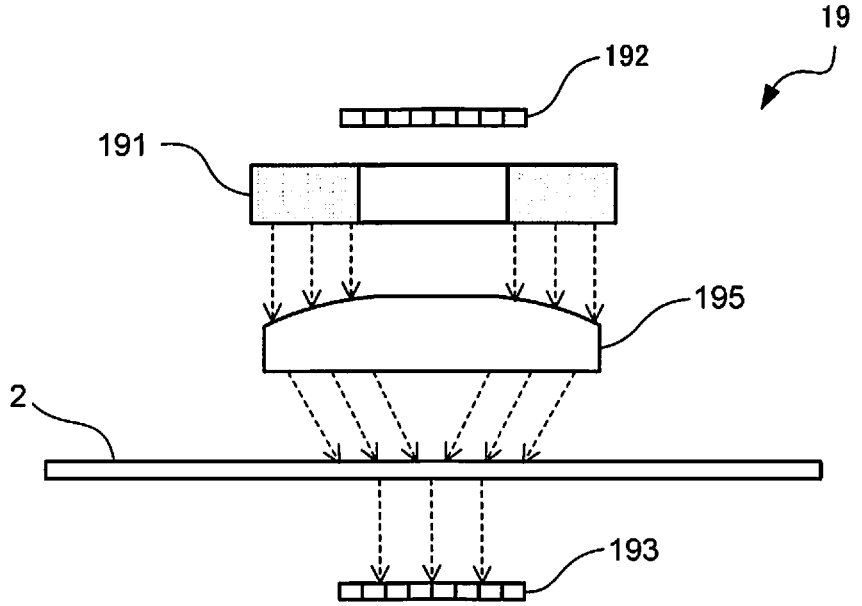

Next, the ejection inspection section of the liquid droplet ejection device 6 will be explained. FIG. 2 schematically shows a configuration of the ejection inspection section 19 of the liquid droplet ejection device 6, in which FIG. 2A is a simplified explanatory diagram in a case of using a reflected light recognizing section from a recording medium, and FIG. 2B is a simplified explanatory diagram in a case of using a transmitted light recognizing section from a recording medium.

In FIG. 2, the ejection inspection section 19 includes an LED (Light Emitting Diode) light source 191 as an irradiating part which irradiates a test pattern formed on the recording medium 2 for ejection inspection with light, a light collecting mirror 195, and a light recognizing part which recognizes reflected light or transmitted light of the light emitted from the LED light source 191 and reaching the recording medium 2 via the light collecting mirror. The light recognizing part of the present embodiment has two sections including a CCD (Charge Coupled Device) for reflected light 192 as a reflected light recognizing section and a CCD for transmitted light 193 as a transmitted light recognizing section.

In FIG. 1A which explains the overall configuration of the liquid droplet ejection device 6 in the above, the LED light source 191 and the CCD for reflected light 192 among the components of the ejection inspection section 19 are attached to the carriage 16, and the CCD for transmitted light 193 is embedded into the stage 9. However, the present invention is not limited to this. It is sufficient for each component of the ejection inspection section 19 to be provided such that ejection inspection can be conducted. For example, a configuration is possible in which ejection inspection is conducted by providing the ejection inspection section as a separate unit and rearranging the recording medium 2 on which a test pattern in formed in the ejection inspection unit.

Light emitted from the LED light source 191 is one type of detection light of the present invention, and is constructed of single wavelength. As described below, in ejection inspection using the ejection inspection section 19 of the present embodiment, a ring-type LED light source 191 is used for the convenience of using the CCD for reflected light 192 as the reflected light recognizing section out of the two light recognizing part.

However, the light source used in the ejection inspection section 19 is not limited to the LED light source 191. For example, another light source such as a laser light source or a halogen light source can be used, and light of complex wavelength or broad light can be used.

The light collecting mirror 195 collects light of the ring-type LED light source 191 into a test pattern formation region of the recording medium 2.

The ejection inspection section 19 is connected to a CPU 42 through an input-output interface 46 and a data bus 47.

In FIG. 2A, the CCD for reflected light 192 as the reflected light recognizing section is an image capturing element which receives reflected light from the recording medium 2 of the light emitted from the LED light source 191 to the recording medium 2, and recognizes it by converting it into electrical signals.

In FIG. 2B, the CCD for transmitted light 193 is an image capturing element which receives transmitted light transmitted through the recording medium 2 of the light emitted from the LED light source 191 to the recording medium 2, and recognizes it by converting it into electrical signals.

The CCD for reflected light 192 and the CCD for transmitted light 193 can be used by selecting either one appropriately depending on the kind or the like of the liquid or the recording medium in use. Specifically, in one inspection ejection, either one of the CCD for reflected light 192 and the CCD for transmitted light 193 is used.

The image capturing element used as the reflected light recognizing section or the transmitted light recognizing section is not limited to a CCD. For example, another image capturing element using a CMOS (Complementary Metal Oxide Semiconductor) or the like can be used.

Electric Control System of Liquid Droplet Ejection Device

Figure 3:
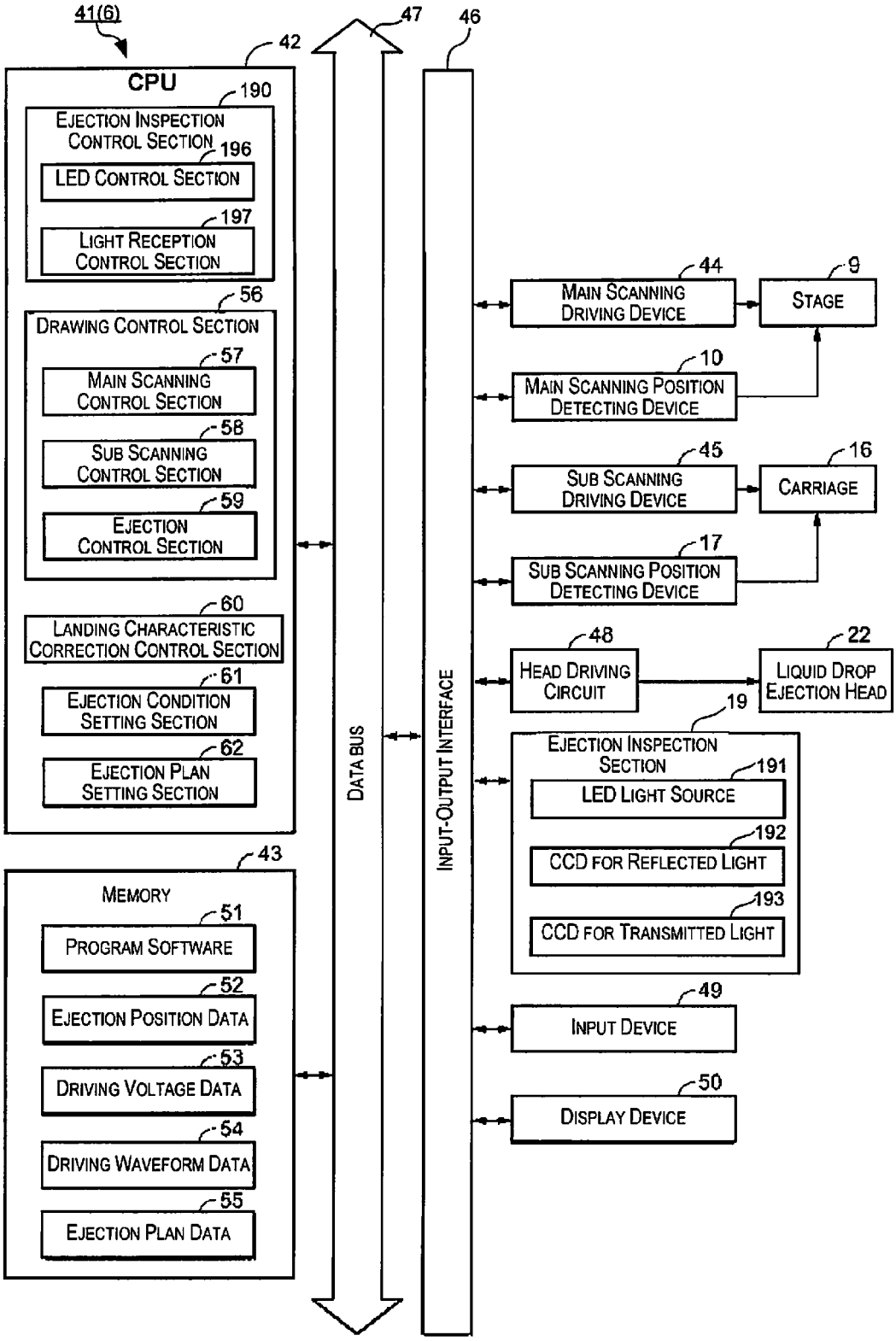
FIG. 3 is a block diagram of electric control of the liquid droplet ejection device.

Next, an electric control system of the liquid droplet ejection device 6 including the ejection inspection section 19 will be explained. FIG. 3 is a block diagram of electric control of the liquid droplet ejection device 6.

As shown in FIG. 3, the liquid droplet ejection device 6 has a control device 41 as a control section which controls an operation of the liquid droplet ejection device 6. The control device 41 has a CPU (central processing unit) 42 which conducts various kinds of arithmetic processing as a processor, and a memory 43 as a storing section which stores various kinds of information.

A main scanning driving device 44, the main scanning position detecting device 10, a sub scanning driving device 45, and the sub scanning position detecting device 17 are connected to the CPU 42 through the input-output interface 46 and the data bus 47. Further, a head driving circuit 48 which drives the liquid droplet ejection head 22, an input device 49, and a display device 50 are connected to the CPU 42 through the input-output interface 46 and the data bus 47.

The ejection inspection section 19, which includes the LED light source 191 as the irradiating part, the CCD for reflected light 192 as the reflected light recognizing section, and the CCD for transmitted light 193 as the transmitted light recognizing section, is connected to the CPU 42 through the input-output interface 46 and the data bus 47.

The main scanning driving device 44 is a device which controls movement of the stage 9, and the sub scanning driving device 45 is a device which controls movement of the carriage 16. The stage 9 can be moved to and stopped at a desired position by detecting the position of the stage 9 with the main scanning position detecting device 10 and driving the stage 9 with the main scanning driving device 44. Likewise, the carriage 16 can be moved to and stopped at a desired position by detecting the position of the carriage 16 with the sub scanning position detecting device 17 and driving the carriage 16 with the sub scanning driving device 45.

The input device 49 is a device which inputs various kinds of processing conditions for ejecting the liquid droplets 29, and for example, a device which receives a coordinate for ejecting the liquid droplets 29 onto the recording medium 2 from an external device which is not shown in the drawing and inputs it. The display device 50 is a device which displays processing conditions or operation status, and an operator conducts an operation using the input device 49 based on information displayed on the display device 50.

The memory 43 is a concept which includes a semiconductor memory such as a RAM, a ROM, or the like, and an external device such as a hard disk, a DVD-ROM, or the like. In terms of the function, a storing region for storing program software 51, in which the control procedure of operations in the liquid droplet ejection device 6 is stored, is set. Further, a storing region for storing ejection position data 52, which is coordinate data of the ejection position for ejection on the recording medium 2, is also set.

In addition, a storing region for storing a plurality of ejection conditions such as driving voltage data 53, driving waveform data 54, and the like is set. The driving voltage data 53 is data which shows the relationship between the driving waveform in driving the liquid droplet ejection head 22 and the ejection amount. The driving waveform data 54 is data for driving the liquid droplet ejection head 22. Further, a storing region for storing ejection plan data 55, which is data of driving voltage in each position for ejection, is set. Furthermore, a storing region serving as a work area for the CPU 42, a temporary file, or the like, and various kinds of storing regions are set.

The CPU 42 conducts control for ejecting the liquid droplets 29 onto predetermined positions on the recording medium 2 in accordance with the program software 51 stored in the memory 43. The CPU 42 has a drawing control section 56 and an ejection inspection control section 190 as specific function achieving sections. The drawing control section 56 conducts control for drawing by ejecting the liquid droplets 29 from the liquid droplet ejection head 22, and the ejection inspection control section 190 conducts control for carrying out ejection inspection of the liquid droplet ejection head 22 by the ejection inspection section 19.

Seeing the details of the drawing control section 56, the drawing control section 56 has a main scanning control section 57 which conducts control for causing the stage 9 to perform main scanning movement at a predetermined speed in the main scanning direction. In addition, the drawing control section 56 has a sub scanning control section 58 which conducts control for causing the liquid droplet ejection head 22 to move by a predetermined sub scanning amount in the sub scanning direction. Further, the drawing control section 56 has various kinds of computing sections or control sections such as an ejection control section 59 for controlling the liquid droplet ejection head 22 to be activated so as to eject the liquid droplets 29 corresponding to which nozzle among the plurality of nozzles existing in the liquid droplet ejection head 22. Here, the ejection control section 59 also has a function of controlling the liquid ejection amount to be appropriate for being able to accurately recognize the physical amount of a test pattern formed with transparent ink in the ejection inspection of the present embodiment.

The ejection inspection control section 190 has an LED control section 196 and a light reception control section 197. The LED control section 196 conducts control for causing the LED light source 191 to scan in a predetermined position and emit laser light to a liquid droplet landing position on the recording medium 2. The light reception control section 197 conducts control to light reception of the CCD for reflected light 192 which captures an image by receiving reflected light from the recording medium 2 irradiated with the laser light or the CCD for transmitted light 193 which captures an image by receiving transmitted light.

In addition, a landing characteristic correction control section 60 is provided to correct the landing position of the liquid droplets 29 ejected by the liquid droplet ejection head 22 onto the recording medium 2 by acquiring a correction value based on a displacement amount of the physical amount (landing characteristics) such as the landing position or the landing area of confirmation dots (test pattern) detected by the liquid droplet ejection head 22 and the ejection inspection section 19 with respect to an appropriate physical amount of dots and providing feedback to the drawing control section 56. Further, an ejection condition setting section 61 is provided to set the ejection amount of the liquid droplets 29 and the number of times of ejection from the liquid ejection nozzle 24 based on the amount of the functional liquid 26 ejected onto an application region and the ejection characteristics.

In addition to this, an ejection plan setting section 62 is provided to set a driving waveform of the piezoelectric element 28 in each position of ejecting the liquid droplets 29.

Ejection Inspection Method

Next, an explanation will be made on an ejection inspection method by the liquid droplet ejection device 6 provided with the ejection inspection section 19.

Figure 4A:
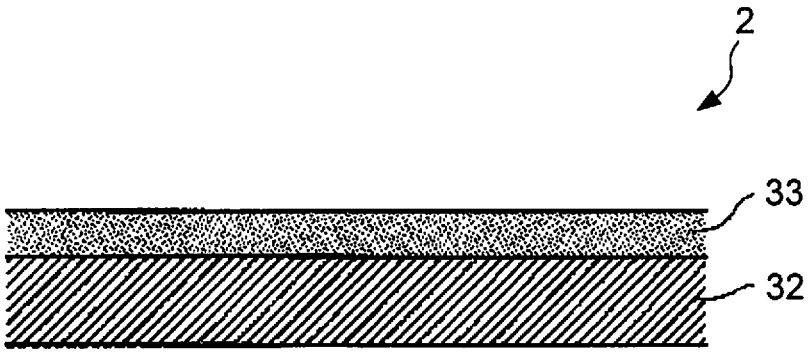
FIGS. 4A and 4B are partial sectional views which explain an example of a recording medium used in an ejection inspection method according to the present embodiment.
Figure 4B:
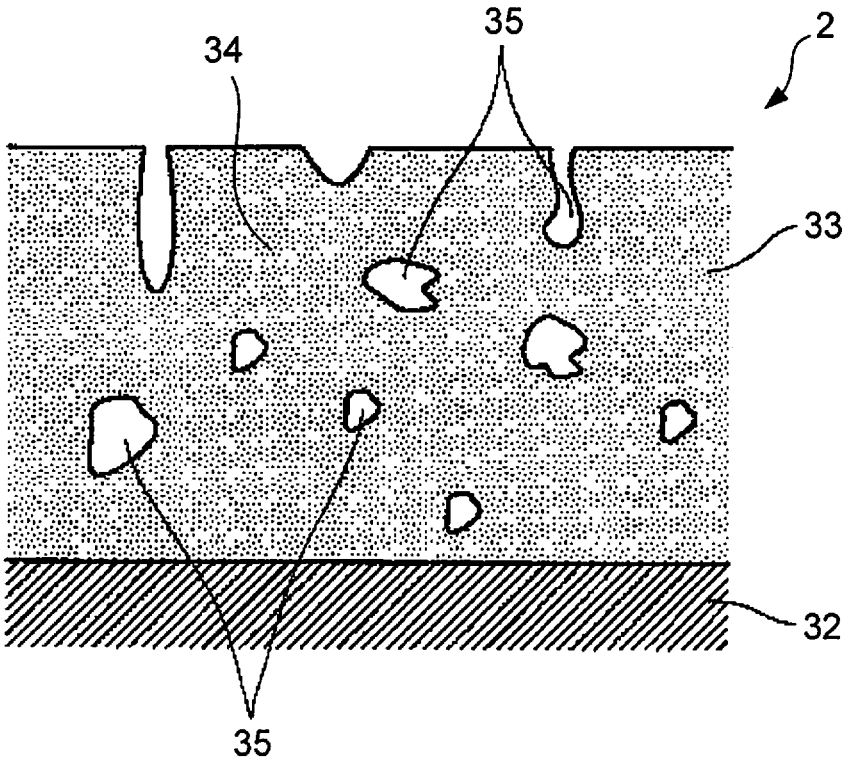

First, the recording medium as an inspection target of ejection inspection of the present embodiment will be explained. FIG. 4 is a partial sectional view which schematically explains an example of the recording medium 2 used in the present embodiment.

In FIG. 4, the recording medium 2 used in the present embodiment has a base material 32, and an ink absorption layer 33 laminated on the base material 32.

Various materials can be applied to the base material 32. In the ejection inspection of the present embodiment, preferably, a material appropriate for the base material 32 is selected depending on whether the CCD for reflected light 192 or the CCD for transmitted light 193 is used as the light recognizing part of the ejection inspection section 19. Specifically, the CCD for reflected light 192 is allowed to receive good reflected light by using a material which reflects light or absorbs light for the base material 32 in a case of conducting the ejection inspection by recognizing reflected light from the recording medium 2 with the CCD for reflected light 192. Also, the CCD for transmitted light 193 is allowed to receive good transmitted light by using a transparent material which has high light transmittance for the base material 32 in a case of conducting the ejection inspection by recognizing transmitted light from the recording medium 2 with the CCD for transmitted light 193. Alternatively, in an opposite manner, it may be possible to determine whether the CCD for reflected light 192 or the CCD for transmitted light 193 is used in the ejection inspection depending on the material in use of the base material 32 of the recording medium 2.

In the ink absorption layer 33, a great number of void cells 35 are formed by dispersing particles such as silica or alumina into a transparent joining material (binder) 34 such as PVA or the like. Although the surface of the joining material 34 of the ink absorption layer 33 is extremely smooth, moisture such as liquid is allowed to permeate by forming a great number of void cells 35 of the order of several μm or less with particles of silica or alumina. Here, the particle diameter of the void cell 35 is made sufficiently small with respect to the wavelength of light for irradiating the recoding medium onto which liquid droplets are caused to land in the ejection inspection. For example, in a case where the ejection inspection is conducted by emitting visible light whose wavelength is several hundred nm, it is desired to form the void cells 35 having a particle diameter of around several ten nm which is around one tenth of it.

Figure 5A:
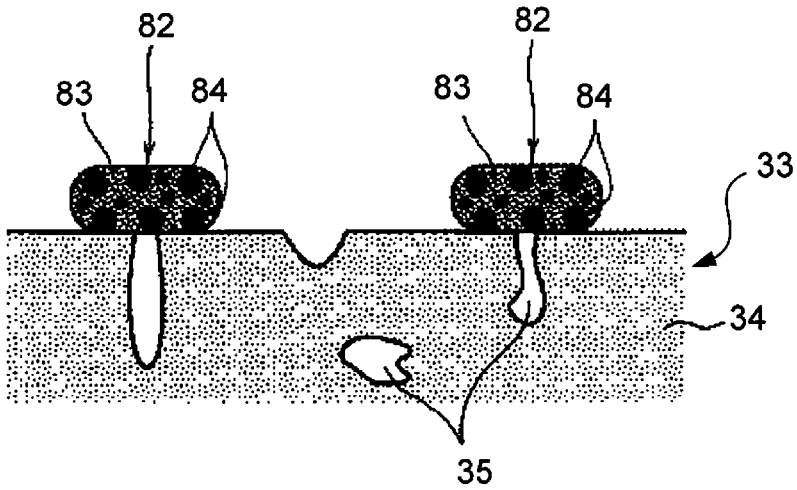
FIGS. 5A to 5C are diagrams which explain a state in which liquid droplets of liquid landing onto a recording medium permeate.
Figure 5B:
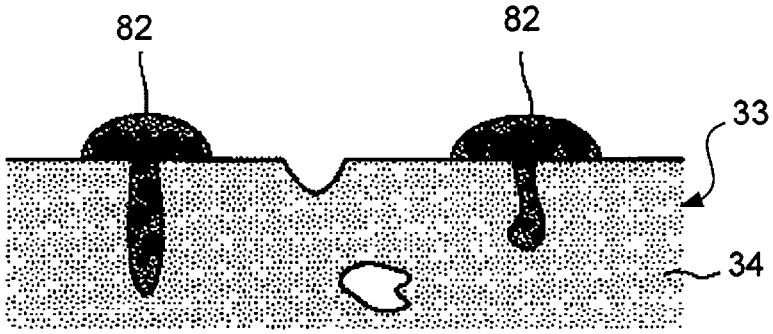
Figure 5C:
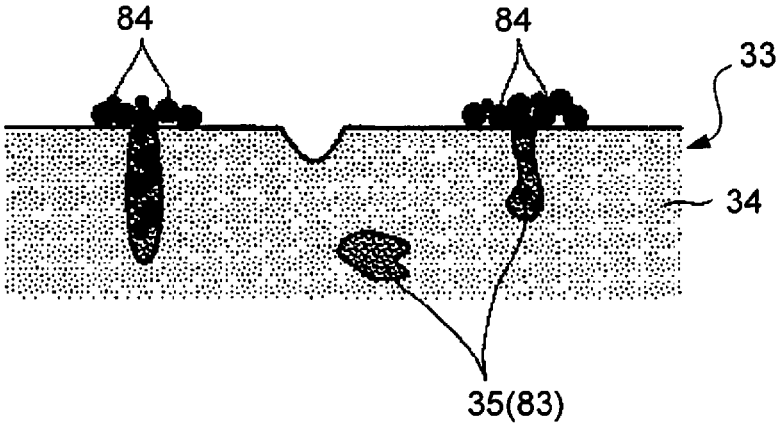

FIG. 5 is a schematic diagram which explains a state in which liquid droplets landing onto the recording medium 2 having the above-described ink absorption layer 33 permeate.

In FIG. 5, liquid droplets of transparent ink 82 as liquid are caused to land onto the surface of the ink absorption layer 33 of the recording medium 2 of the above-described configuration from the liquid droplet ejection head 22 of the liquid droplet ejection device 6. As this transparent ink 82, for example, colorless transparent one constructed of moisture 83, polymer fine particles 84 such as polyethylene or polypropylene, a penetrating agent, and the like can be used. As schematically shown in FIG. 5, when the transparent ink 82 lands onto the surface of the ink absorption layer 33, the polymer fine particles 84 as a solid component remain on the surface of the ink absorption layer 33. Specifically, the transparent ink 82 landing onto the surface of the ink absorption layer 33 tries to permeate the base material 32 by passing through the void cells 35 dispersed into the ink absorption layer 33, and in this instance, the moisture 83 and the penetrating agent having a low molecular weight and high fluidity preferentially permeate. Consequently, the fluidity of the polymer fine particles 84 will be lowered. Also, the polymer fine particles 84 start aggregating and the particle diameter increases as the moisture 83 is lost, and the fluidity will further be lowered. As a result, part of the polymer fine particles 84 in the transparent ink 82 permeates the base material (32) located under the ink absorption layer 33 in the vertical direction with the assistance of the penetrating agent or the moisture 83; however, most of the polymer fine particles 84 remain on the surface of the ink absorption layer 33 and in the vicinity of the surface inside the ink absorption layer 33, and are fixed.

Figure 6A:
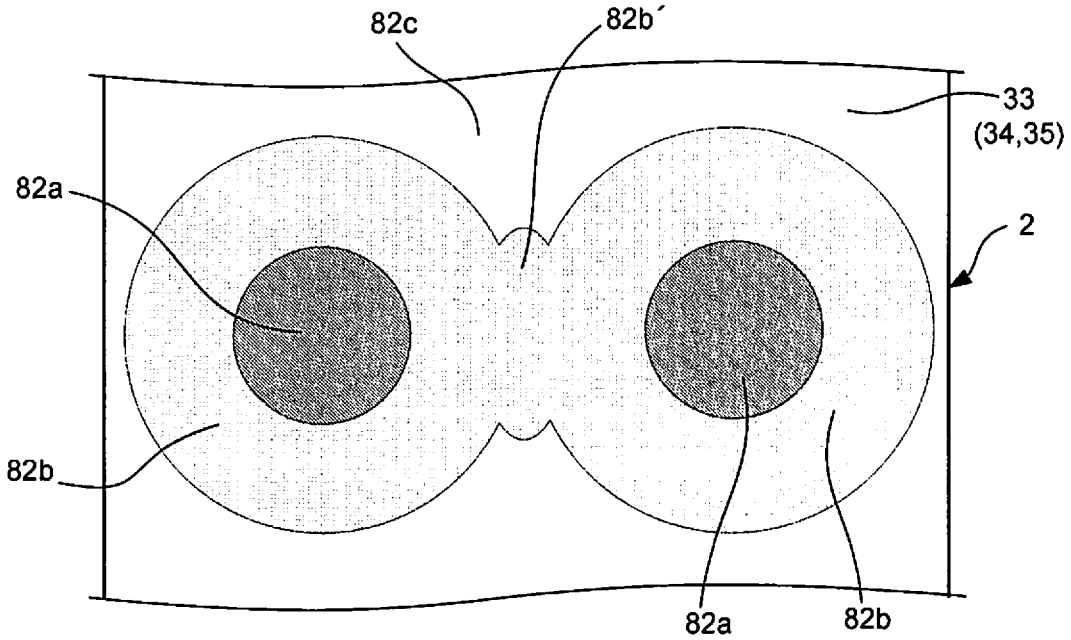
Figure 6B:
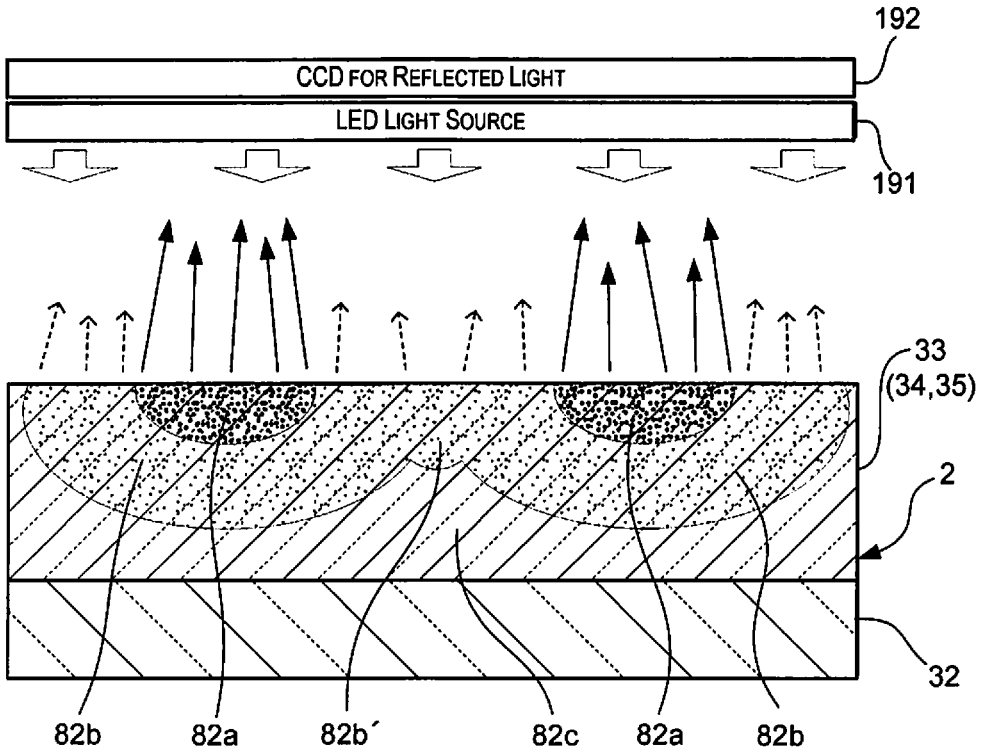

Next, an explanation will be made on an ejection inspection method for the liquid droplet ejection head 22 using the recording medium 2 of the above-described configuration. FIG. 6 schematically shows an embodiment of the ejection inspection method, in which FIG. 6A is a plan view of a test pattern caused to land on a recording medium as a pattern for ejection inspection, and FIG. 6B is a schematic view which explains the ejection inspection method with respect to a section of the recording medium 2. In the recording medium 2 shown in FIG. 6B, the void cells 35 of the ink absorption layer 33 explained in FIG. 5 is not illustrated.

In the ejection inspection of the present embodiment, first, a test pattern for ejection inspection is formed by ejecting the transparent ink (82) as liquid (functional liquid) from the liquid droplet ejection head 22 onto the surface of the ink absorption layer 33 of the recording medium 2. As shown in FIG. 6, the ejection amount of the functional liquid 26 is adjusted such that a region where the transparent ink 82 is filled and a region where the transparent ink 82 is not filled exist in a thickness direction and a horizontal direction of the ink absorption layer 33 in which the void cells (35) are dispersed into the joining material (34).

In FIG. 6, the transparent ink (82), which permeates the ink absorption layer 33 and is fixed, forms a high filling area 82*a* of an especially high filling ratio formed around the landing position, a low filling area 82*b* of a low filling ratio formed to surround the high filling area 82*a*, and a substantially no filling area 82*c*. In this instance, if the transparent ink (82) is filled at a ratio of 10% to 90% with respect to the ink absorption layer 33, the physical amount of the landing transparent ink (82) can be detected in the ejection inspection method of the present embodiment.

When dots of the transparent ink (82) ejected from the liquid ejection nozzle (24) onto the recording medium 2 collide with each other in a short time as the landing transparent ink (82) permeates the ink absorption layer 33, the dots prevent each other from soaking and spreading (the state of a low filling area 82*b*' in FIG. 6A), and reach a state of being highly filled in the high filling area 82*a* at an early stage. In this manner, the adjacent dots in the landing ink affect each other in permeation into the ink absorption layer 33. Therefore, attention needs to be paid for determining the ejection amount and the ejection position (landing position) of the ink in the ejection inspection method of the present embodiment.

Next, laser light is emitted from the LED light source 191 toward the test pattern formed by the transparent ink 82 fixed to the recording medium 2.

Next, reflected light from the recording medium 2 of the light emitted from the LED light source 191 is converted into electrical signals and recognized by the CCD for reflected light 192.

Image processing calculation is conducted by an image processing device, which is not shown in the drawing, to image capturing data of the test pattern recognized by the CCD for reflected light 192, and thus the physical amount such as the landing diameter (ejection amount) or the landing position of the transparent ink (82) which has landed and has been fixed onto the recording medium 2 can be calculated. In this instance, as shown in FIG. 6B, the boundary between the high filling area 82*a* and the low filling area 82*b* of the transparent ink (82), and the boundary between the low filling area 82*b* and the substantially no filling area 82*c* of the transparent ink (82) can be recognized by the CCD for reflected light 192. The physical amount such as the ejection amount or the landing position of the test pattern of the transparent ink (82) can be detected by recognizing the boundary between the high filling area 82*a* and the low filling area 82*b* with a difference in the refractive index between strong reflected light from the high filling area 82*a* shown by a solid-line arrow and weak reflected light from the low filling area 82*b* shown by a broken-line arrow, and the boundary between the low filling area 82*b* and the substantially no filling area 82*c* with a difference in the refractive index between weak reflected light from the low filling area 82*b* and weaker reflected light from the substantially no filling area 82*c* which is not shown in the drawing.

In the present embodiment, the CCD for reflected light is used. However, reflected light of laser light of the test pattern for ejection inspection formed by ejecting the transparent ink 82 with an appropriate amount can be recognized with the naked eye. Ejection inspection such as determination of existence or non-existence of a defective dot due to clogging in the nozzle of the liquid droplet ejection head 22 is sufficiently possible by recognition with the naked eye.

In a case where the displacement amount of the calculated value of the physical amount such as the landing diameter (ejection amount) or the landing position of the transparent ink (82) which has landed and has been fixed onto the recording medium 2 with respect to a predetermined appropriate physical amount exceeds an acceptable range, the physical amount such as the ejection amount or the ejection position of liquid such as the transparent ink (82) ejected from the liquid droplet ejection head 22 onto the recording medium 2 can be corrected by acquiring a correction value based on the displacement amount of the physical amount (landing characteristics) such as the landing position or the landing area of the test pattern with respect to the appropriate physical amount of dots and providing feedback to the drawing control section 56 by the landing characteristic correction control section 60.

As described above, according to the present embodiment, even in a case of using the transparent ink 82 which is hard to observe or recognize in a conventional ejection inspection method which optically recognizes a test pattern formed by observable liquid such as color ink, it becomes possible to observe or recognize the test pattern. Also, detection of the physical amount such as the landing position or the landing area (ejection amount) of the transparent ink 82 (liquid) is possible as well as detection of existence or non-existence of the test pattern (existence or non-existence of nozzle malfunction). Specifically, even in a case of using the transparent ink 82 as liquid, highly accurate ejection inspection of the liquid ejection nozzle 24 can be conducted by detecting the physical amount of the test pattern which has landed onto the recording medium 2 without using a complicated and expensive optical system or image processing device.

Also, as the light recognizing part which recognizes light from the recording medium of light emitted from the LED light source 191, the liquid droplet ejection device 6 of the present embodiment has the CCD for reflected light 192 as the reflected light recognizing section which recognizes reflected light from the recording medium 2, and the CCD for transmitted light 193 as the transmitted light recognizing section which recognizes transmitted light from the recording medium 2.

With this, inspection (ejection inspection) of the test pattern can be conducted by selecting and recognizing either one of reflected light or transmitted light from the recording medium 2 of light emitted from the LED light source 191 depending on the kind or the like of the liquid or the recording medium in use.

Although the embodiments of the present invention made by the inventors were explained in detail, the present invention is not limited to the above-described embodiments, and various modifications are possible without departing from the scope of the present invention.

For example, the liquid droplet (liquid) ejection inspection device and the ejection inspection method using the same according to the present invention achieve significant effects in a liquid ejection nozzle provided in an inkjet head as a liquid droplet ejection head by an inkjet method. However, the present invention is not limited to inkjet, and can be applied to ejection inspection in another liquid ejection nozzle such as a dispenser or a micropipette and a liquid ejection device provided with the same, for example.

In the above-described embodiment, the piezoelectric element 28 is used as a pressurizing part for pressurizing the cavity 25 in the liquid droplet ejection head 22. However, another technique can be used. For example, pressure can be applied by deforming the vibration plate 27 using a coil and a magnet. Alternatively, pressure can be applied by providing a heater wiring in the cavity 25 and heating the heater wiring so as to vaporize the functional liquid 26 or expand gas contained in the functional liquid 26. Alternatively, pressure can be applied by deforming the vibration plate 27 using an attraction force and a repulsion force of static electricity.

The above-described embodiments are described mainly with respect to a liquid ejection device provided with an ejection inspection section and an ejection inspection method in a liquid ejection method using the same. It is apparent that these include a disclosure of a printing device, a recording device, a liquid ejection device, a printing method, a recording method, a liquid ejection method, a printing system, a recording system, a computer system, a program, a recording medium which stores a program, or the like.

A printer and the like as one embodiment were explained in the above. However, this is for easy understanding of the present invention, and it should not be interpreted to limit the present invention. It is apparent that the present invention can be changed or modified without departing from the gist thereof, and the present invention includes the equivalents thereof.

In the above-described embodiment, as one example of the liquid droplet ejection device 6 (inkjet printer), a so-called serial printer is described, which ejects liquid (the transparent ink 82) from the liquid ejection nozzle 24 by moving the liquid droplet ejection head 22 provided with the liquid ejection nozzle 24 in a predetermined direction with respect to the recording medium 2. However, the present invention is not limited to this, and for example, a line printer in which liquid is ejected from a liquid ejection nozzle onto a recording medium which moves in a predetermined direction with respect to a line head which is provided with the liquid ejection nozzle and does not move.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An ejection inspection method comprising:

preparing a liquid ejection nozzle for ejecting liquid onto a recording medium;

irradiating a pattern formed by the liquid ejected onto the recording medium with light; and conducting ejection inspection of the liquid ejection nozzle based on the light from the recording medium, wherein the recording medium includes an ink absorption layer having light transmittance where a great number of void cells having a particle diameter smaller than wavelength of the light are dispersed into a joining material, and an ejection amount of the liquid is adjusted such that first and second regions of the void cells exist in a thickness direction and a horizontal direction in planar view of the ink absorption layer, with the void cells in the second region having a smaller amount of ink than the void cells in the first region.

2. The ejection inspection method according to claim 1, wherein the light from the recording medium is electrically recognized by an image capturing element.

3. The ejection inspection method according to claim 1, wherein the liquid ejection nozzle is a nozzle provided in a liquid droplet ejection head for ejecting liquid as liquid droplets by an inkjet method.

4. The ejection inspection method according to claim 1, wherein the liquid is transparent liquid having high light transmittance.

5. The ejection inspection method according to claim 1, wherein the ejection amount of the liquid is adjusted such that, in addition to the first and second regions of the void cells, a third region of the void cells further exists in the thickness direction and the horizontal direction in the planar view of the ink absorption layer, with the void cells in the third region having a smaller amount of ink than the void cells in the first region and having a larger amount of ink than the void cells in the second region, and the conducting of the ejection inspection of the liquid ejection nozzle including conducting the ejection inspection of the liquid ejection nozzle based on a boundary position between the first region and the third region and a boundary position between the third region and the second region.

6. An ejection inspection device comprising:

a liquid ejection nozzle configured and arranged to eject liquid onto a recording medium; and an ejection inspection section having an irradiating part configured and arranged to irradiate a pattern formed by the liquid ejected onto the recording medium with light and a light recognizing part configured and arranged to recognize light from the recording medium irradiated with the light of the irradiating part, the ejection inspection section being configured and arranged to conduct ejection inspection of the liquid ejection nozzle based on results recognized by the light recognizing unit, wherein the recording medium includes an ink absorption layer having light transmittance in which a great number of void cells having a particle diameter smaller than wavelength of the light are dispersed into a joining material, the ejection inspection device further comprises an ejection control section configured and arranged to adjust an ejection amount of the liquid such that first and second regions of the void cells exist in a thickness direction and a horizontal direction in planar view of the ink absorption layer, with the void cells in the second region having a smaller amount of ink than the void cells in the first region, and the light recognizing part includes a reflected light recognizing section configured and arranged to recognize reflected light of the light from the recording medium and a transmitted light recognizing section configured and arranged to recognize transmitted light of the light from the recording medium.

7. The ejection inspection device according to claim 6, wherein the reflected light recognizing section includes an image capturing element which electrically recognizes the reflected light from the recording medium, and the transmitted light recognizing section includes an image capturing element which electrically recognizes the transmitted light from the recording medium.

8. The ejection inspection device according to claim 6, wherein the liquid ejection nozzle is a nozzle provided in a liquid droplet ejection head for ejecting liquid as liquid droplets by an inkjet method.

9. The ejection inspection device according to claim 6, wherein transparent liquid having high light transmittance is used as the liquid.

10. The ejection inspection device according to claim 6, wherein the ejection control section is configured and arranged to adjust the ejection amount of the liquid such that, in addition to the first and second regions of the void cells, a third region of the void cells further exists in the thickness direction and the horizontal direction in the planar view of the ink absorption layer, with the void cells in the third region having a smaller amount of ink than the void cells in the first region and having a larger amount of ink than the void cells in the second region, and the ejection inspection section being configured and arranged to conduct the ejection inspection of the liquid ejection nozzle based on a boundary position between the first region and the third region and a boundary position between the third region and the second region.

* * * * *